US007597041B2

(12) United States Patent
Gerstadt et al.

(10) Patent No.: US 7,597,041 B2
(45) Date of Patent: Oct. 6, 2009

(54) WEAPON HAVING AN ECCENTRICALLY-PIVOTED BARREL

(75) Inventors: Stefan Gerstadt, Gerlingen (DE); Roland Kirchberger, Stuttgart (DE); Bernhard Stehlin, Leinfeiden (DE)

(73) Assignee: Moog GmbH (DE)

( * ) Notice: Subject to any disclaimer, the term of this patent is extended or adjusted under 35 U.S.C. 154(b) by 36 days.

(21) Appl. No.: 11/637,540

(22) Filed: Dec. 12, 2006

(65) Prior Publication Data

US 2007/0144338 A1 Jun. 28, 2007

(30) Foreign Application Priority Data

Dec. 12, 2005 (DE) ..... 10 2005 059 225

(51) Int. Cl.
*F41G 5/00* (2006.01)
*F41G 3/00* (2006.01)
*F41G 5/14* (2006.01)

(52) U.S. Cl. ..... 89/203; 89/202; 89/204; 89/205; 89/41.01; 89/41.02; 89/41.09; 235/404; 235/407

(58) Field of Classification Search ..... 89/202–205, 89/41.01–41.02, 41.09; 235/404, 407; 42/94
See application file for complete search history.

(56) References Cited

U.S. PATENT DOCUMENTS 2,394,021 A * 2/1946 Stone ..... 89/28.2
2,436,379 A * 2/1948 Chinn ..... 89/41.12
3,659,494 A * 5/1972 Philbrick et al. ..... 89/28.05
3,854,378 A * 12/1974 Vogel ..... 89/37.08
4,012,860 A * 3/1977 Auger ..... 42/94
4,062,126 A * 12/1977 O'Hara et al. ..... 89/202
4,265,111 A * 5/1981 Teiling ..... 73/178 R
4,621,266 A * 11/1986 Le Gall et al. ..... 342/359
5,020,411 A * 6/1991 Rowan ..... 89/1.11
5,123,327 A * 6/1992 Alston et al. ..... 89/1.813
5,347,910 A * 9/1994 Avila et al. ..... 89/41.22
5,413,028 A * 5/1995 Ng et al. ..... 89/41.09
6,571,678 B1 * 6/2003 Bar ..... 89/41.02

(Continued)

FOREIGN PATENT DOCUMENTS

DE 3633375 A1 * 4/1988

*Primary Examiner*—Bret Hayes
*Assistant Examiner*—Michael D David
(74) *Attorney, Agent, or Firm*—Phillips Lytle LLP

(57) ABSTRACT

The present invention relates generally to a weapon having an eccentrically-pivoted barrel (1) that is mounted on a movable base (2), and to a method of elevating and stabilizing such a barrel. A drive mechanism (3) acts between the barrel and the base to permit and enable the elevation of the barrel relative to the base to be selectively changed. A compensation device acts between the barrel and base to compensate for the unbalance of the barrel. The compensation device includes a gyroscope (13) mounted on the barrel and arranged to provide an output signal, a set point generator (12), a closed-loop control device (10) and an actuating element (16). The actual position of the barrel is sensed by the gyroscope, which supplies its output signal to the set point generator. The set point generator produces a set force value as a function of the gyroscope output signal. The set force value is supplied to the closed-loop control device, which produces a set point value that is, in turn, supplied to the actuator for controllably changing the elevation of the barrel.

8 Claims, 4 Drawing Sheets

U.S. PATENT DOCUMENTS 6,715,397 B2 * 4/2004 Bar ..... 89/41.02
6,871,439 B1 * 3/2005 Edwards ..... 42/84
6,935,218 B2 * 8/2005 Urvoy ..... 89/37.07
7,143,681 B2 * 12/2006 Hartmann et al. ..... 89/41.02
2003/0177897 A1 * 9/2003 Bar ..... 89/41.02
2003/0183070 A1 * 10/2003 Schneider et al. ..... 89/203
2004/0200345 A1 * 10/2004 Hartmann et al. ..... 89/1.815
2007/0119296 A1 * 5/2007 Niv et al. ..... 89/37.02

* cited by examiner

WEAPON HAVING AN ECCENTRICALLY-PIVOTED BARREL

TECHNICAL FIELD

The present invention relates generally to a weapon having an eccentrically-pivoted barrel that is mounted on a movable base, and to a method of elevating and stabilizing such a barrel.

BACKGROUND ART

Weapons having projectile-firing barrels that are pivotally mounted on a base and that can be aimed at a target, are preferably supported at the center of gravity of the barrel in order to minimize the drive energy needed to change the elevation of the barrel relative to the base from one position to another, and to reduce torque disturbances that act on the barrel when the base moves relative to the ground. Drive energy is only needed to angularly move the barrel, and to overcome bearing friction, when the base moves and/or the aim on a relatively-moving target is to be maintained.

When the barrel is not mounted for pivotal movement about its center of gravity (i.e., is mounted for pivotal movement about an eccentric axis), additional torque is required to maintain the aim of the weapon on the target. Depending upon the type of drive technology employed, additional power losses may arise in supplying this additional unbalance-compensating torque. Moreover, when the barrel is to be elevated relative to the base, the drive mechanism must supply additional unbalance-compensating torque, and such additional torque as may be needed to move from one elevation to another. Thus, the drive mechanism must be designed to supply the sum of both torques. This also implies the use of larger inertial masses for the moving parts to be accelerated, which, in turn, requires the drive to supply even more torque.

With electrical drives, the torque is provided by a supplied electrical current. However, these drives have additional power losses in the motor, in the cables, and in the drive electronics. Moreover, some supplied current is transformed into heat.

If the current-supplying voltage is to be supplied by a vehicle battery, which is often the case with mobile weapon carriers, and if the barrel elevation is to be changed with the vehicle engine switched off, the battery will be discharged. Thus, when the engine is not running, there are practical time limits due to current drain to changes in barrel elevation.

Unbalance compensation devices using mechanical and pneumatic springs are known. These devices can maintain the barrel substantially in balance within its range of aiming motion. Such springs typically act between the base and the barrel such that the torque produced by such springs is substantially equal to the torque attributable to the unbalance of the barrel. Some unbalance compensation devices have used hydraulic springs that have included a hydraulic actuator and an pneumatically-pressurized hydraulic accumulator.

The relative position between the base and barrel can affect the torque exerted therebetween. For example, if the barrel is aimed and stabilized on a target, and if the base is moved over an undulating terrain, the base will exert a changing torque on the barrel as the relative position between the base and barrel changes. However, an off-target deviation is only detected by the gyroscope after the barrel has already deviated from its desired on-target aimed position.

Pneumatic springs can be designed to have a relatively-flat spring rate; i.e., such that the force exerted by the spring changes only slightly with spring displacement. On the other hand, pneumatic springs, which typically occupy a smaller volume than mechanical springs, also have higher friction. When used between a moving base and a stabilized locked-on-target barrel, this increased friction leads to the generation of extraneous disturbing torques and a diminution of stabilization quality because for each change in relative movement between the base and barrel, a change in torque arises in the unbalance compensation device.

Both the mechanical spring and the pneumatic spring must be coupled by an intermediate mechanism between the barrel and base such that the torque acting on the weapon corresponds, at least approximately, to the unbalance torque attributable to the relative position between the base and barrel. To achieve this, complex levers, gear mechanisms, or torsion bars have been required. These devices have involved a compromise between the full equivalence of the unbalance torque and the compensation torque. With a moving base traversing undulating terrain, torque equality between the barrel and base can be upset by such external disturbances.

Drive solutions are also known in which two drives that interact with one another are employed. In one such device, a motor that is designed for maximum rotational speed is operated only when the rotational speed that another motor, designed for slower speeds, cannot deliver. Since the more-slowly rotating motor requires less current for the same torque delivered, the required continuous power is reduced. The disadvantage of this solution is that the maximum or peak power is not reduced; rather, only the continuous power is reduced.

DE 3633375 A1 discloses a weapon having an eccentrically-pivoted barrel mounted on a base. A spring combination is provided to compensate for the resulting torque unbalance. The angle of the base with respect to a horizontal axis is measured. This angle is designated $\eta$. A vertical sensor provides a set point value. The longitudinal offset of the spring combination is fed as an actual value to a closed-loop control circuit. This control circuit ensures movement of the spring combination to the extent that the base is again aligned horizontally. The angular offset of the base from an artificial horizon and the strain of the spring combination are selected as measurement parameters.

French publication FR 2491611 discloses another device and method for aiming a barrel. The barrel is not supported eccentrically. A gun is supported on a cradle on which the aiming device is mounted. Within the aiming device, a breech or catch element is mounted on eight different uniformly-distributed spring/damper combinations. Two optoelectronic measurement devices determine the absolute position of the breech or catch device. A gyroscopically-stabilized mirror is used in the optoelectronic device. The optoelectronic device also determines the stresses prevailing in the spring/damper combinations with the aid of electronic circuits.

U.S. Pat. No. 2,436,379 discloses a device for eliminating the backlash in an aiming device for a weapon. This patent also discloses a device for preventing variations in the yoke on which the weapon is mounted. To do this, a control voltage, which acts on a weighing unit with valves, is produced via a gyroscope. Depending on the angular position, either of two valves is brought into sealed engagement with a connection passing hydraulic oil. These connections are in fluid contact with oil contained in a cylinder. The cylinder also contains a piston which is coupled to the barrel. Depending on the angular position of the ground, either one or the other valve is opened or closed so that oil is passed form one part of the cylinder to the other part of the cylinder. A similar principle is disclosed in U.S. Pat. No. 2,394,021.

Similar devices appear to be disclosed in Japanese Pat. No. JP 2000283874, published British Pat. Appln. GB 2015126 A, and French publication No. FR 2851799.

DISCLOSURE OF THE INVENTION

With parenthetical reference to the corresponding parts, portions or surfaces of the disclosed embodiment, merely for purposes of illustration and not by way of limitation, the present invention broadly provides improvements in a weapon system having an eccentrically-pivoted barrel, and to an improved method of elevating and stabilizing such an eccentrically-pivoted barrel.

In one aspect, the invention provides an improvement in a weapon having a barrel (1) mounted on a base (2) for pivotal movement relative thereto about an axis (4) positioned at an eccentric location other than at the center of gravity of the barrel, having a drive mechanism (3) acting between the base and barrel for selectively changing the elevation of the barrel relative to the base, and having a unbalance compensation device acting between the base and barrel to compensate for the unbalance of the barrel. The unbalance compensation device includes a gyroscope (13) mounted on the barrel and arranged to generate an output signal as a function of the actual position of the barrel, a set point generator (12) arranged to generate a set force value as a function of the gyroscope output signal, a closed-loop device (e.g., a comparator) (10) supplied with the set force value and arranged to produce a set point, and an actuating element (16) supplied with the set point for causing the barrel to move in response to the set point. The improvement comprises: a force-measuring element (7) arranged to sense the force exerted by the unbalance compensation device on the base and to produce an output signal; wherein the force-measuring element output signal (in line 8) is compared with the set force value (in line 11) in the closed-loop device (10) to produce an error signal (in line 15); and wherein the actuating signal supplied to the actuating element is varied as a function of the error signal.

The actuating element (16) may be integrated into at least one of the drive mechanism (3) and compensation device.

The unbalance compensation device may include a motor-driven toothed sprocket (19).

The error signal may be arranged to cause selective movement of the toothed sprocket (19).

The unbalance compensation device may includes at least one of a mechanical spring (6), a hydraulic spring and a pneumatic spring. The mechanical spring (6) may be formed of steel. Alternatively, the unbalance compensation device may include a plurality of springs (6) arranged in parallel with one another, and wherein the force-measuring element (7) is arranged to sense the force exerted by the plurality of springs.

The drive mechanism (3) may support the unbalance compensation device.

In another aspect, the invention provides an improved method of aiming and stabilizing a weapon having a barrel (1) mounted on a base (2) for pivotal movement relative thereto about an axis (4) positioned at a location other than at the center of gravity of the barrel, and having a drive mechanism (3) acting between the base and barrel for selectively changing the elevation of the barrel relative to the base. This method comprises the steps of: providing an unbalance compensation device to act between the base and barrel to compensate for the unbalance of the barrel, the unbalance compensation device including a gyroscope (13) mounted on the barrel, a set point generator (12), a force-measuring device (7) and a closed-loop device (e.g., a comparator) (10); causing the gyroscope to generate an output signal (in line 14) indicating the actual position of the barrel; supplying the gyroscope output signal to the set point generator (12); causing the set point generator to produce a set force value (in line 11) as a function of the gyroscope output signal; providing a force-measuring element (7) arranged to sense the actual force exerted by the unbalance compensation device on the base and to produce an output signal (in line 8); causing the closed-loop device (10) to compare the set force value with the value of the actual force and to produce an error signal (in line 15); producing a set point as a function of the error signal; and supplying an actuating signal to the drive mechanism as a function of the error signal; thereby to cause the barrel to move.

The drive mechanism may be arranged to move the unbalance compensation device, and may be moved by an actuating element.

The unbalance compensation device may include a ladder chain (18), and the actuating element may include a toothed sprocket (19) engaging the chain.

The actuating element may include a closed-loop torque control circuit.

The set force value may be determined as a function of the spatial velocity of the barrel, and/or the force value is determined as a function of the position of the barrel relative to the base.

The set force value may also be determined as a function of the spatial position of the barrel.

Accordingly, the general object of the invention is to provide an improved system for aiming and stabilizing an eccentrically-mounted barrel of a weapon relative to a movable base.

Another object is to provide an improved method for aiming and stabilizing an eccentrically-mounted barrel of a weapon relative to a movable base.

These and other objects and advantages will become apparent from the foregoing an ongoing written specification, the drawings and the appended claims.

DESCRIPTION OF THE PREFERRED EMBODIMENTS

Figure 1:
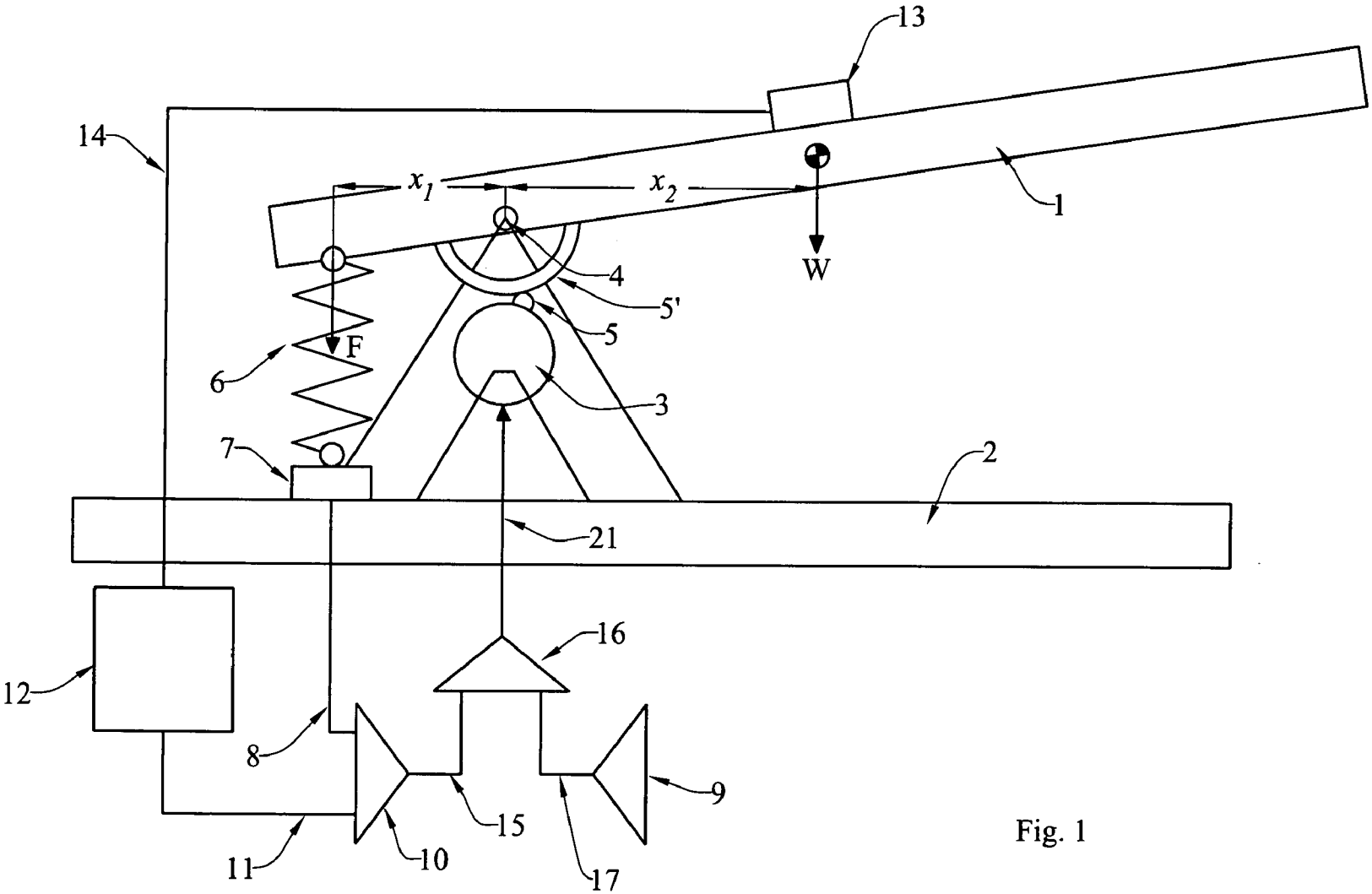
FIG. 1 is a schematic illustration of a first embodiment of a weapon having an eccentrically-pivoted barrel mounted on a movable base.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., crosshatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, FIG. 1 illustrates a weapon having an eccentrically-pivoted barrel 1 supported in a bearing 4 on a movable base 2. A drive mechanism 3 with a drive motor is mounted on the base and is connected mechanically to the barrel via meshing gears 5, 5'. The barrel is not supported at its center of gravity. A spring 6 acts between the left marginal end of the barrel and a force transducer 7 mounted on the base. Spring 6 exerts a force (F) on the barrel at one arm distance ($x_1$) from pivot point 4 to produce a counterclockwise torque that opposes a clockwise gravitational torque attributable to the weight (W) of the barrel acting at the center of gravity, which is displaced by another arm distance ($x_2$) from the pivot point.

The actual compensation force exerted by spring 6 on base 2 is sensed by force transducer 7, which supplies an actual compensation torque output signal via line 8 to one input of a comparator 10. The signal supplied via line 8 is compared (i.e., is algebraically summed) with a needed compensation torque signal (set force value) supplied via line 11 from a set point generator 12 to produce a compensation torque error signal in comparator output line 15 reflective of the difference between the two inputs. The needed compensation torque signal in line 11 is determined as a function of spatial position of the barrel, which is supplied to set point generator 12 by an elevation angle output signal in line 14 of barrel-mounted gyroscope 13. Preferably, the effects of friction between the gears 5, 5' are cancelled to reduce, if not eliminate, a disturbing torque attributable to such friction. It should be noted that the force transmitted by spring 6 to force transducer 7 is a function of the position of the barrel relative to the base. In order to obtain a needed compensation torque signal that is independent of the position of the base relative to the ground and is solely dependent upon the so-called inertial aiming angle of the barrel, the spatial position of the barrel is derived from a gyroscope 13 mounted on the barrel. Gyroscope 13 is arranged to provide a signal in line 14 that is reflective of the actual position of the barrel in space, and is independent of the position of base 2. The elevation angle signal in line 14 is supplied as an input to set point generator 12, which produces a needed compensation torque output signal in line 11 that is independent of the position of the base.

Since gyroscope output signals generally exhibit a drift, and only measure changes-in-angle (i.e., not absolute angle), the angular position between the barrel and the base can also be measured to compensate for the drift and to provide an absolute reference between the barrel and base when switching on. The drift compensation and the generation of the initial condition of the needed compensation torque signal are not illustrated in FIG. 1, because they are known in the prior art.

Comparator 10 is arranged to produce a compensation torque error signal in line 15 reflective of the difference between the needed compensation torque (supplied as an input via line 11) and the actual compensation torque (supplied as an input via line 8). This compensation torque error signal is then made available to the drive mechanism as a compensation torque error signal. This compensation torque error signal is, in turn, supplied as an input to a summing point 16, which receives other set point quantities at its other input via line 17. These other set point quantities are derived from the drive and stabilization closed-loop control, represented by amplifier 9. The various inputs to summing point 16 are superimposed, resulting in a compensated torque drive signal 21 which is supplied to the motor of actuator 3.

Preferably, the current supplied to the actuator motor is controlled such that the sum of the torque exerted on the barrel due to the current from the compensation torque error signal and the torque produced by the spring, counteract the gravitational torque acting on the barrel.

Advantageously, the drive mechanism 3 can also be provided with an internal torque closed-loop control circuit (not shown). If this circuit is provided, the set point quantity in line 15 can be supplied to this torque control circuit as a manipulating variable. The advantage is that the desired compensation torque is then available more quickly at the barrel than when only the current required for the torque is fed to the motor. The extent of this dvantage depends on the dynamic properties of the drive mechanism.

Amplifier 9 represents the external closed-loop control circuit that is responsible for aiming the weapon, and thus the barrel, and for closed-loop stabilization control. Amplifier 9 processes different measurement signals and supplies them via line 17 as an input to summing point 16. It is not important whether the control of the position of the weapon is derived from a gyroscope mounted on the weapon itself (such as on the barrel), or tracks an already-stabilized guiding device (e.g., a stabilized optical system). Nor is it important how many, and with which, measurement quantities the closed-loop control of the aiming angle occurs and how this control circuit is constructed and adjusted.

Figure 2:
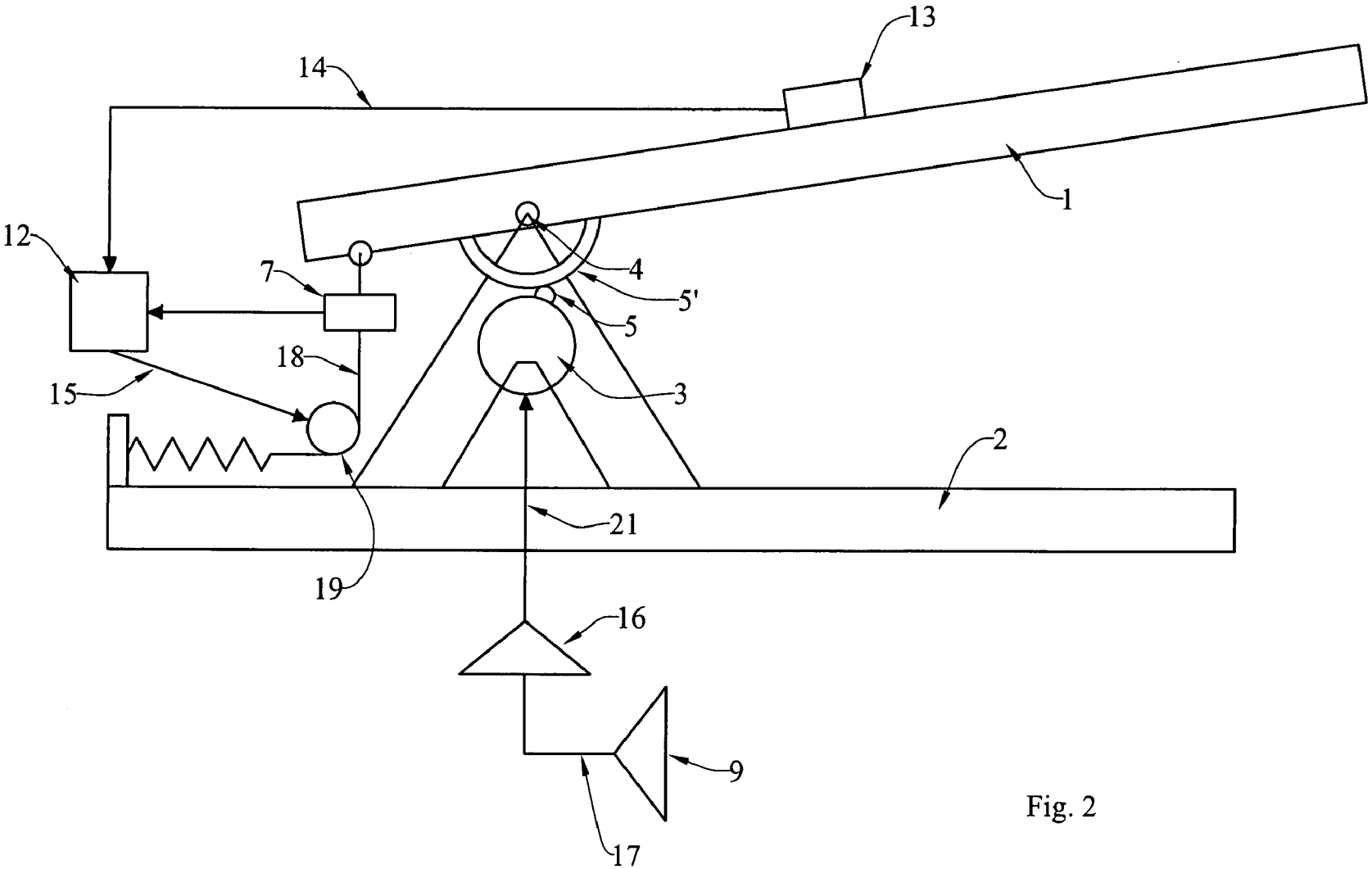
FIG. 2 is a schematic illustration of a second embodiment of a weapon having an eccentrically-pivoted barrel mounted on a movable base.

FIG. 2 depicts a second embodiment of the invention, and illustrates another way in which the drive system can be implemented. In FIG. 2, the force transducer 7 is shown as being mounted between the barrel and an elastic compensator. This elastic compensator is joined to the base via a ladder chain 18, which passes around a toothed sprocket 19, and which is connected to a separate drive unit (not shown).

The differential signal (in line 15) between the actual and desired compensating torque is supplied as the set point signal for the current torque control circuit of the drive unit that drives sprocket 19. With suitable dimensioning of the drive unit, and with suitable signal processing, the sum of the torques, caused by the spring and drive unit together, acting on the barrel are adequate to counter the gravitational torque.

Figure 3:
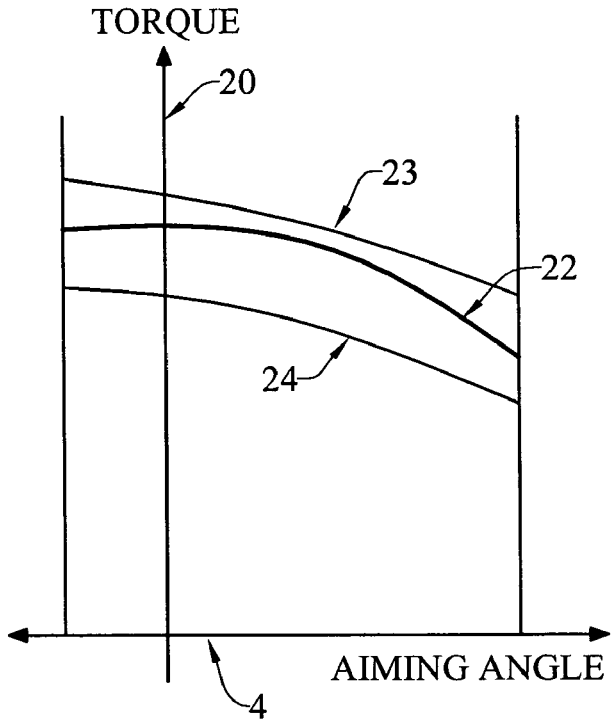
FIG. 3 is a plot of torque (ordinate) vs. aiming angle (abscissa).

FIG. 3 is a plot of torque (ordinate) vs. elevation angle (abscissa) of the weapon barrel. Trace 22 shows the change of the gravitational torque of the weapon barrel with variations in the inertial aiming angle. Traces 23 and 24 bracket the torque effect on the weapon barrel of a possible spring which is affected by hysteresis and which is to be directed against the unbalance. More particularly, trace 23 represents the torque on Compressing the spring, and trace 24 illustrates the torque on expanding the spring. If a gas spring is used for the spring, traces 23 and 24 will also change with the temperature of the gas. Moreover, the trace will also change with the angle of the base, as the spring is shortened or lengthened. Moreover, viscous friction will occur on lengthening or shortening of the spring.

Figure 4:
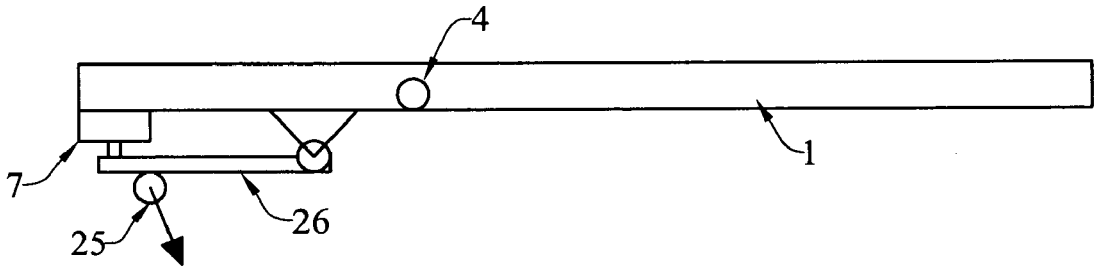
FIG. 4 is a schematic view showing a device for the direct measurement of torque exerted on the weapon by means of a force-measuring element in the form of a force transducer (dynamometer/load cell).

The actual torque exerted on the barrel by the spring can be measured directly by, for example, the measurement device illustrated in FIG. 4.

In FIG. 4, a force-measuring element 7 (e.g., a force transducer) is mounted at a fixed angle and at a fixed distance to the pivot point 4 of the barrel. The spring engages a rocker 26 at point 25. One end of the rocker is supported on element 7 and the other end is mounted for movement with the barrel. Thus, the torque exerted by the spring on the barrel is always in a fixed relationship to the force measured by force-measuring element 7, regardless of the direction from which the spring engages the rocker. Thus, the difference between the actual unbalance torque of the barrel and the spring torque acting on the barrel can be determined at any point in time and for any angle of the barrel. The difference is then supplied as a set point to the drive mechanism, as described above.

Figure 5:
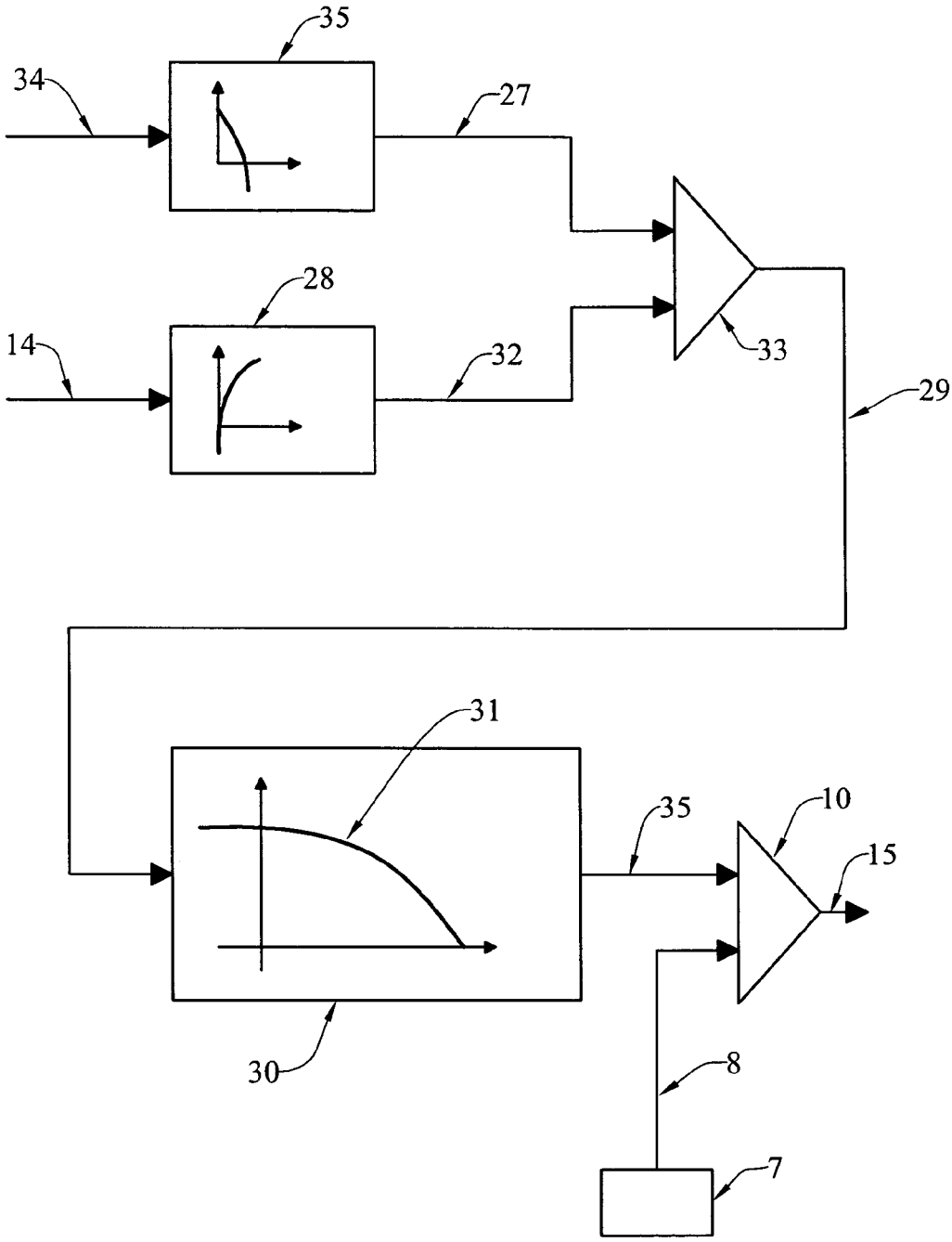
FIG. 5 is a schematic illustration of the control configuration.

FIG. 5 depicts a control configuration. More particularly, FIG. 5 shows how a set point (see the signals in lines 15 in FIGS. 1 and 2) can be formed to control torque. The angular position between the barrel and base is sensed by an encoder (not shown), and is supplied via line 34 to an electronic filter, represented by block 35. Alternatively, an inertial position value can be used. Only a unidirectional or DC component of the signal supplied via line 34 is passed on to line 27. Thus, the high frequency components are filtered out by filter 33.

The actual position of the barrel is supplied via line 14 to a block 28 in which the low-frequency components (e.g., drift) are filtered out. Thus, block 28 produces an output signal inline 32 that is the AC component of the signal supplied via line 14. The DC signal in line 27 from the encoder, and the AC signal in line 32 from the gyroscope, are superimposed in summing point 33 to provide an angular position signal in line 29. This signal is supplied as an input to block 30. Block 30 produces a desired torque signal in output line 35 according to a torque-angle characteristic indicated by trace 31. The torque value in line 35 is then compared with the torque attributable to the force sensed by force-measuring element 7. These two torque signals are supplied as inputs to comparator 10. The output of comparator 10 in line 15 is the set point (FIG. 1), or difference (FIG. 2), that is supplied to the drive mechanism.

The advantage of this drive concept, in which an elastic spring together with the described force measurement and control of drive torque using a current or force closed-loop control circuit, exerts a desired compensating force on the barrel.

If a pneumatic cylinder is chosen as the elastic spring, it should be assumed that such spring will have a pronounced force hysteresis; i.e., when the spring is compressed, it will exert a different force than when it is released. Without the invention described herein, this property renders pneumatic spring unsuitable for use as a compensator for dynamic systems in which the barrel is to be inertially stabilized in an aimed position while the base moves. The disturbance torques, which are caused by the changes of force during a change in the direction of movement, are too large. This disadvantage can be compensated with the described closed-loop control of the differential force.

In addition, all elastic springs cause a change in the compensating force during a movement of the base without the control described herein, if the base moves in the direction of the barrel position. With the closed-loop control described herein, this is compensated if the absolute inertial position of the weapon barrel is taken as a measure of the weapon position, and not the one relative to the base. This absolute position of the weapon barrel can be derived from the barrel gyroscope, which is already present for barrel stabilization.

A further disadvantage of elastic springs, without the use of the closed-loop controller described above, is that they typically require, depending on their design, a costly kinematic linkage between the barrel and abase if they are to provide good compensation of the unbalance torque, as it changes with the angle in all positions of the aiming angle. With most compensators, the torque which compensates the unbalance compensation device on the weapon barrel changes in a manner different from the manner by which the unbalance torque of the barrel changes when the aiming angle changes. An actuating force, which changes with the aiming angle and which does not change identically in the opposite sense with the unbalance torque, forms, together with the inertial mass of the weapon, a system capable of vibrating, which can disturb the closed-loop control of the inertial position of the weapon if excitation at the resonance frequency occurs, which may be the case with a moving base.

With the force measurement and control according to this invention, the inertial mass can be prevented from oscillating on the spring if the compensating force of the compensator is controlled such that, with a change of the barrel position, an equilibrium with the unbalance arises. Thus, this advantage is also eliminated from spring compensators.

With known so-called electrical compensators in which two motors are controlled such that at low rotational speeds, a suitable motor only requires a lower electrical power, another motor must be provided to provide full peak power. This peak power is computed from the unbalance torque and the maximum required aiming or compensation velocity when the base moves. With an elastic compensator with the described closed-loop control, the peak torque is noticeably reduced depending on the rating of the compensator. A combination between the electrical compensator and the controlled spring compensator described herein is possible, above all when the electrical drive system is to have an electrical emergency operating mode.

Therefore, while two forms of the improved system and method have been shown and described, and several modifications thereof discussed, persons skilled in this art will readily appreciate that various additional changes and modifications may be made without departing from the spirit of the invention, as defined and differentiated in the following claims.

What is claimed is:

1. The method of counteracting the gravitational torque acting on a weapon barrel (1) that is pivotally mounted on a base (2) at a location spaced from the center of gravity of said barrel (1), comprising the steps of:

providing a spring (6);

positioning said spring (6) between said barrel (1) and said base (2) to exert a force (F) therebetween;

providing a force transducer (7);

positioning said force transducer (7) so as to measure said force (F) and to produce an actual compensation force signal;

converting said actual compensation force signal into an actual compensation torque signal (8);

providing a gyroscope (13);

mounting said gyroscope (13) on said barrel (1) to determine the elevation angle of said barrel (1) relative to a horizon and to produce an elevation angle signal (14);

providing a set point generator (12);

causing said set point generator (12) to generate a needed compensation torque signal (11) reflective of the torque necessary to counteract said gravitational torque as a function of said elevation angle signal (14);

summing said actual compensation torque signal (8) with said needed compensation torque signal (11) to Produce a compensation torque error signal (15);

providing a desired torque drive signal (17) reflective of a desired torque to be transmitted between said barrel (1) and said base (2);

summing said desired torque drive signal (17) with said compensation torque error signal (15) to generate a compensated drive signal (21);

providing an actuator (3) between said barrel and base to selectively apply a torque therebetween;

operating said actuator (3) as a function of said compensated drive signal (21);

thereby to counteract said gravitational torque acting on said barrel (1).

2. The method as set forth in claim 1 wherein said actuator (3) is arranged to move said spring (6).

3. The method as set forth in claim 2 wherein said actuator (3) is an electric motor.

4. The method as set forth in claim 1 wherein said spring (6) includes a chain (18) and wherein said actuator (3) includes a toothed sprocket (19) engaging said chain.

5. The method as set forth in claim 1 wherein said actuator (3) includes a closed-loop torque control circuit (16).

6. The method as set forth in claim 1 wherein said needed compensation torque signal (11) is determined as a function of the elevation of said barrel.

7. The method as set forth in claim 6 wherein said needed torque signal (11) is determined as a function of the angle of said barrel (1) relative to said base (2).

8. The method as set forth in claim 6 wherein said needed compensation torque signal (11) is determined as a function of the spatial position of said barrel (1).

* * * * *